US006519858B2

(12) United States Patent
Willoughby

(10) Patent No.: US 6,519,858 B2
(45) Date of Patent: Feb. 18, 2003

(54) NON-THREADED FASTENER REMOVAL TOOL

(76) Inventor: Ric L. Willoughby, 91023 Marcolla Rd., Springfield, OR (US) 97478

( * ) Notice: Subject to any disclaimer, the term of this patent is extended or adjusted under 35 U.S.C. 154(b) by 0 days.

(21) Appl. No.: 09/887,911

(22) Filed: Jun. 21, 2001

(65) Prior Publication Data

US 2002/0194741 A1 Dec. 26, 2002

(51) Int. Cl.[7] ..... B26F 1/32
(52) U.S. Cl. ..... 30/358; 30/316
(58) Field of Search ..... 30/113.1, 118, 30/119, 315, 316, 358; 7/144, 146, 147, 158; 254/18, 19, 28

(56) References Cited

U.S. PATENT DOCUMENTS

| | | | | |
|---|---|---|---|---|
| 2,530,399 A | * | 11/1950 | Pilgrim | 30/123 |
| 2,670,537 A | * | 3/1954 | Campbell | 30/310 |
| 3,990,451 A | * | 11/1976 | Gibbs | 30/358 |
| 4,041,558 A | | 8/1977 | Victor | |
| 4,355,466 A | * | 10/1982 | Quiring | 30/358 |
| 4,658,457 A | | 4/1987 | Rakita | |
| 4,776,568 A | | 10/1988 | Perel | |
| 4,960,235 A | | 10/1990 | Gregory | |
| D374,802 S | | 10/1996 | Spirer et al. | |
| 5,622,352 A | | 4/1997 | Swindall | |
| 5,749,113 A | | 5/1998 | Witter | |

OTHER PUBLICATIONS

Catalogue of unknown supplier, unknown date, p. 1978—page title "Hole Punches & Gasket Cutters".

* cited by examiner

*Primary Examiner*—Hwei-Siu Payer
(74) *Attorney, Agent, or Firm*—Robert E. Howard

(57) ABSTRACT

An impact tool for use in removing a non-threaded fastener from a first substrate anchored to a second substrate by the fastener. The tool includes a shank having a longitudinal axis, first and second ends, and an exterior surface. A driving head is located on one end of the shank and a fastener exposure/dimpling head located on the other end. The fastener exposure/dimpling head includes a fastener receiving cavity, a cutting lip extending outwardly from the fastener receiving cavity, and a dimpling section located between the cutting lip and the outer surface of the shank. The cutting lip is placed around the nailhead and the driving head tapped to expose the nailhead. The dimpling section creates a cavity in the surface of the first substrate which can subsequently be filled.

20 Claims, 2 Drawing Sheets

NON-THREADED FASTENER REMOVAL TOOL

BACKGROUND OF THE INVENTION

The present invention relates to a tool which exposes the head of a non-threaded fastener for easy removal from an object anchored to a wood substrate by the fastener, and prepares the surface of the anchored object adjacent the fastener for easy repair after removal of the fastener.

Non-threaded fasteners, such as nails and staples, are used to anchor many things to a wood substrate. A typical example is the use of nails to attach sheet rock to wooden studs. Nails are used to attach wood to wood, such as attachment of wooden cabinets to wooden studs.

If it is required to remove the nail from the anchored material, claw hammers or special tools having a claw are typically used with the claw being wedged under the nailhead and mechanical extraction leverage applied to the embedded nail shank through the handle of the claw tool. Use of a claw device usually causes considerable surface damage to, or total destruction of, the anchored object during extraction of the nail.

A number of tools have been suggested to alleviate this problem, such as the nail puller tools described in U.S. Pat. Nos. 4,658,457 and 4,776,568. However, these tools do not provide the leverage required to quickly remove the shank of a nail tightly imbedded in the wood substrate.

SUMMARY OF THE PRESENT INVENTION

The present invention provides an impact tool which exposes a fastener head embedded in a substrate for easy engagement by a conventional claw device while saving the visual and physical integrity of the adjoining substrate area, and at the same time creates a dimpled depression thereabout which, after extraction of the fastener, can be easily filled.

The tool includes a cylindrical body portion (shank) one end of which constitutes a driving head and the other end of which constitutes a fastener exposure/dimpling head.

The fastener exposure/dimpling head includes a fastener receiving cavity, a cutting lip extending outwardly from the fastener receiving cavity, and a rounded dimpling section located between the cutting lip and the outer surface of the shank. Preferably, a transition section is located between the cutting lip and the dimpling section.

DESCRIPTION OF PREFERRED EMBODIMENTS

Figure 1:
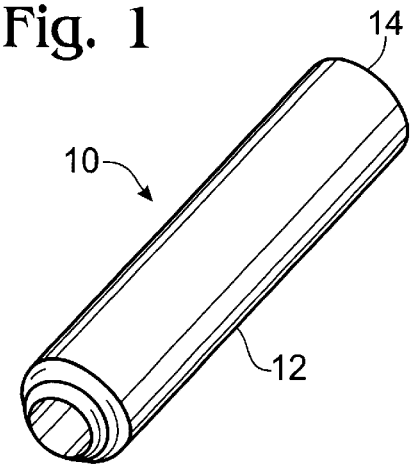
FIG. 1 is a perspective view of the tool of the present invention.
Figure 2:
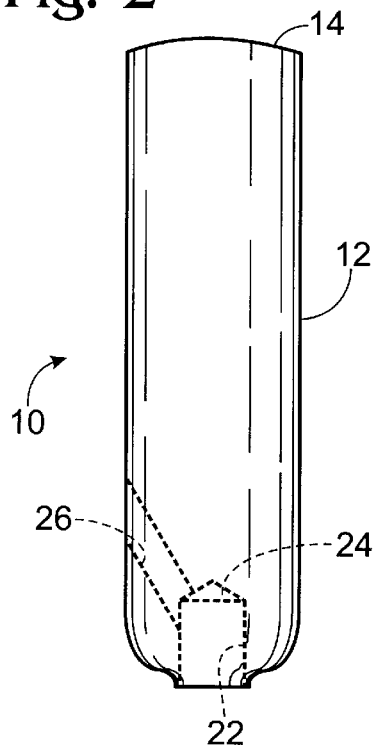
FIG. 2 is an elevation view of the tool of the present invention.
Figure 3:
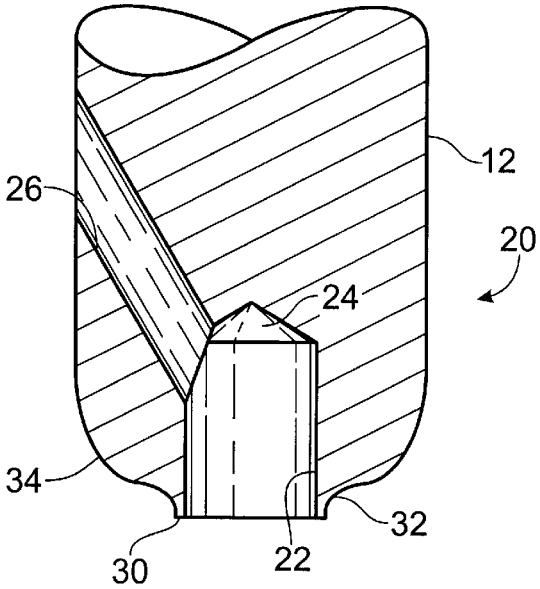
FIG. 3 is an enlarged elevation view of the fastener exposure/dimpling head of the tool of the present invention.
Figure 4:
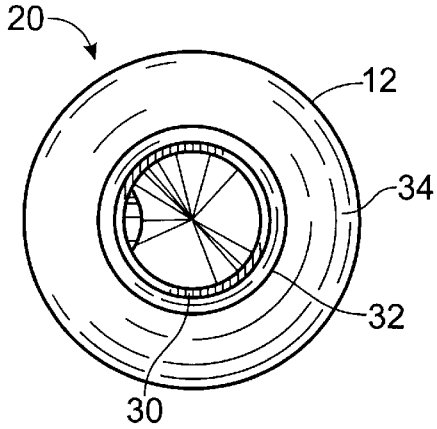
FIG. 4 is an enlarged bottom plan view of the tool of the present invention.

The non-threaded fastener removal tool 10 of the present invention includes a cylindrical body (shank) 12. At one end (the outer end) of shank 12 is a rounded (convex) driving head 14. At the other end (the inner end) of shank 12 is a nailhead exposure/dimpling head 20 (FIG. 4).

Although shank 12 is preferably cylindrical in shape, other shapes may be used.

The length of shank 12 is such as to provide sufficient space for a user to easily grip it with his fingers. A length of about 3 inches to about 4 inches has been found to be satisfactory.

The diameter of shank 12 is such as to provide sufficient space for the proper functioning of the nailhead exposure/dimpling head 20 described below. A diameter of about 1.0 inch or less has been found to be satisfactory.

Head 20 has an interior portion including a cylindrical nailhead receiving cavity 22, a conical end cavity 24 which communicates with nailhead receiving cavity 22, and a cylindrical cleanout channel 26 that communicates nailhead receiving cavity 22 and conical end cavity 24 with the exterior surface of shank 12. Conical end cavity 24 provides easier removal of accumulated debris.

The longitudinal axis of cylindrical nailhead receiving cavity 22 is coaxial with the longitudinal axis of shank 12 of tool 10.

In a preferred embodiment, cylindrical cleanout channel 26 extends upwardly at an angle of about 30 degrees to the longitudinal axis of shank 12 of tool 10.

Nailhead receiving cavity 22 has a diameter slightly larger than the diameter of the nailhead of the nail to be removed. The diameter of nailhead receiving cavity 22 should be close to the diameter of the nailhead, but not so close as to cause the nailhead to be driven into the anchored object and substrate during use of the tool 10. A clearance of about 1/64th of an inch between the periphery of the nailhead and the wall of cavity 22, i.e., an overall diameter of about 1/32 inch greater than the diameter of the nailhead, has been found to be satisfactory for many nail sizes.

For nails having a size of between about 10D and about 20D, a diameter of about 7/16 inch for nailhead receiving cavity 22 has been found to be satisfactory. For nails having a size of between about 3D and about 8D, a diameter of about 3/8 inch for nailhead receiving cavity 22 has been found to be satisfactory. For nails having a size of 2D, a diameter of about 1/4 inch for nailhead receiving cavity 22 has been found to be satisfactory.

The exterior of head 20 includes a cylindrical cutting lip 30, an angled transition section 32 and a rounded dimpling section 34.

Cylindrical cutting lip 30 extends outwardly from nailhead receiving cavity 22 and has an inside diameter that is the same as the diameter of nailhead receiving cavity 22, the longitudinal axis of cutting lip 30 being an extension of the longitudinal axis of nailhead receiving cavity 22. The outer edge of cutting lip 30 is relatively sharp and has a high angle of attack to the surface plane of the anchored substrate (i.e., about 90 degrees) during use, thereby providing quick initial entry of the nailhead exposure/dimpling head 20 into the area of the anchored object adjacent the fastener to be removed.

Although the invention is not limited to any particular wall thickness or depth for cutting lip 30, a wall thickness of about 0.9 mm (0.033 inch) and a depth of about 0.794 mm (0.031 inch) has been found to be satisfactory for many nail sizes.

Angled transition section 32 provides an angle of attack intermediate the substantially perpendicular attack angle of cutting lip 30 and the relatively flat attack angle of rounded dimpling section 34. A transition section 32 having an angle of about 30 degrees to the longitudinal axis of shank 12 of tool 10 has been found to be satisfactory for many nail sizes.

Rounded dimpling section 34 has the lowest angle of attack to the surface of the anchored substrate from which the fastener is being removed. The purpose of rounded dimpling section 34 is to provide sufficient space around the fastener being removed to allow access thereto by a claw removal device. In addition, dimpling section 34 leaves a smooth, dimpled depression around the fastener hole to allow easy filling with patching material after removal of the fastener.

In a preferred embodiment, rounded dimpling section 34 is substantially a one-quarter arc of a circle, preferably having a radius of about 6.35 mm (0.250 inch).

In a preferred embodiment, the distance between the outer edge of cutting lip 30 and the apex of conical end cavity 24 is about 15.875 mm (0.625 inch).

Figure 5:
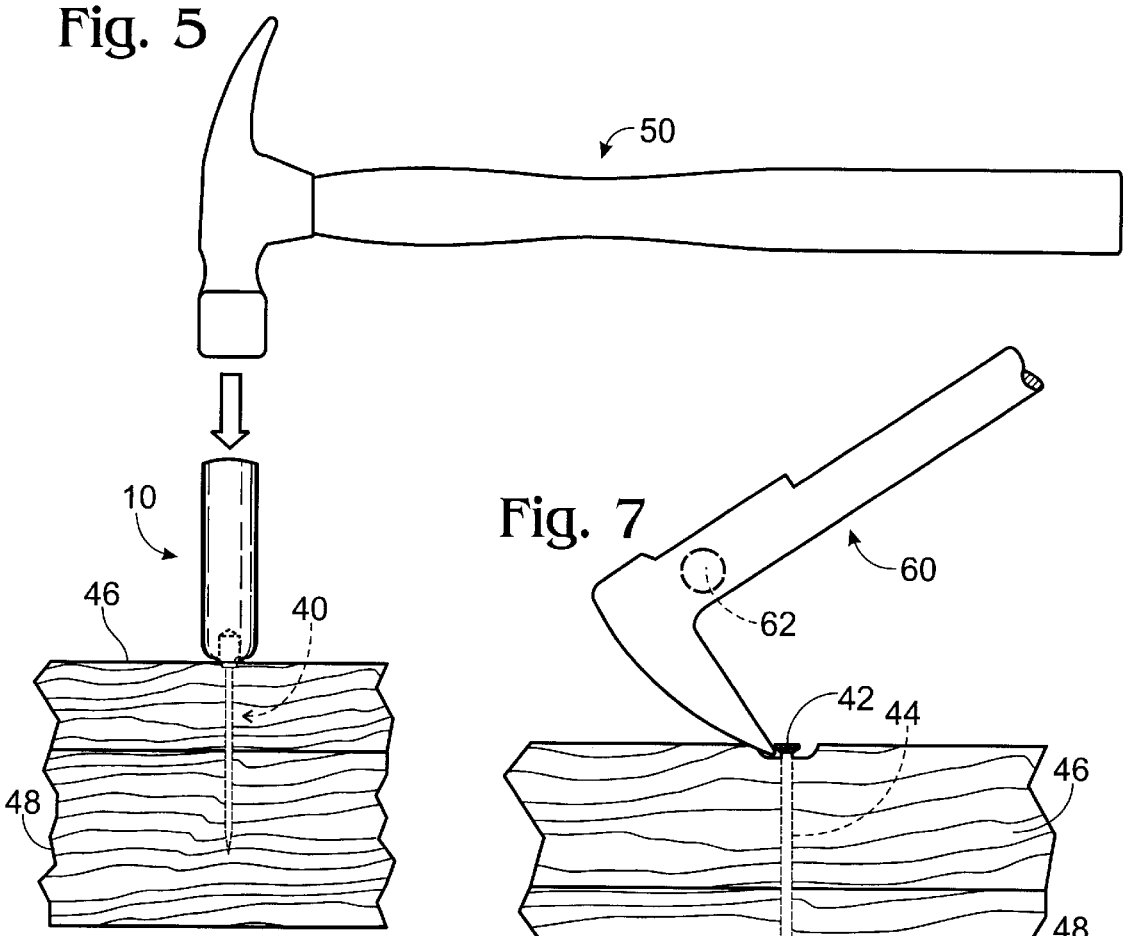
FIG. 5 is an elevation view of the tool of the present invention being tapped into place with a hammer.
Figure 7:
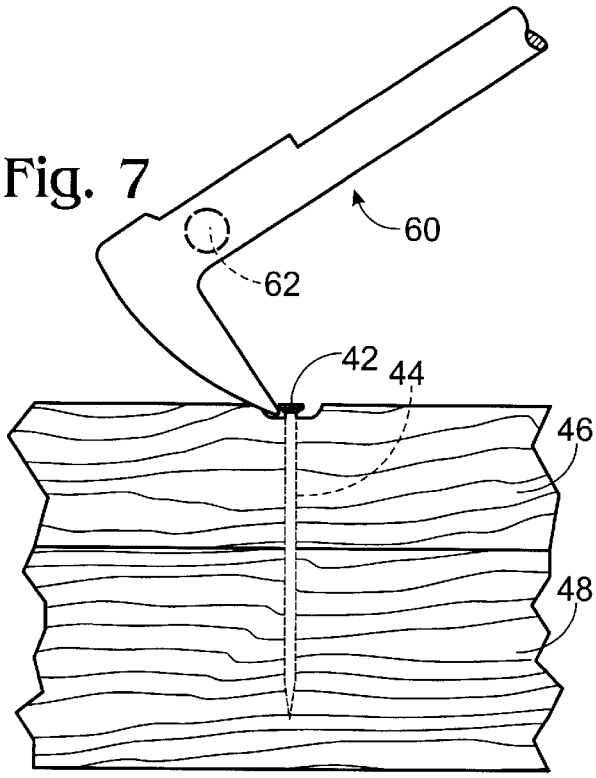
FIG. 7 is an elevation view showing the removal of a nailhead that has been exposed by the tool of the present invention with a conventional claw device.
Figure 6:
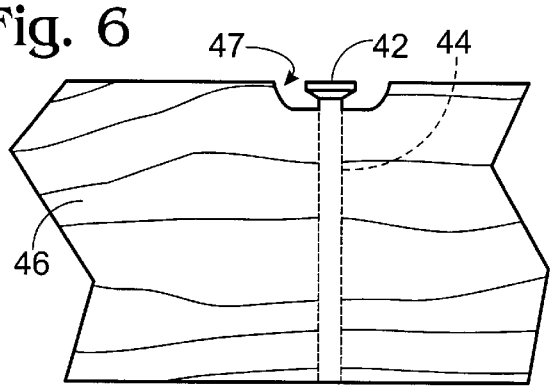
FIG. 6 is an enlarged view of a nailhead and adjacent area of the anchored object after having been subjected to the tool of the present invention.

FIGS. 5–7 illustrate use of tool 10 to remove a nail 40 having a nailhead 42 and a shank 44 from a substrate 46 anchored to wood member 48 by nail 40.

Tool 10 is positioned with the longitudinal axis of shank 12 substantially perpendicular to the surface plane of anchored substrate 46 and with the cutting edge of cylindrical cutting lip 30 surrounding the nailhead 42 of the nail 40 to be removed from the anchored substrate 46 and wood member 48. A hammer 50 is used to drive nailhead exposure/dimpling head 20 into that portion of anchored substrate 46 surrounding nail 40. The hammer 50 is used to strike rounded driving head 14 of tool 10 several times to ensure that the depth of cutting lip 30, transition section 32 and dimpling section 34 is sufficient to expose nailhead 42, and to expose a portion of adjacent shank 44 sufficient to allow a claw to removingly engage nailhead 42.

Upon cutting lip 30 entering the area of the anchored substrate 46 surrounding nailhead 42 and its associated shank 44, any existing mechanical bond or glue bond between the nailhead and the anchored member is broken. As cutting lip 30 is driven downwardly it tends to cause the nailhead 42 to be pushed slightly above the adjacent upper planar surface of the anchored substrate 46, thereby creating additional space for insertion of a claw removal device thereunder.

Tool 10 is then removed, leaving nailhead 42 and a small upper portion of shank 44 exposed, as shown in FIG. 6. A dimpled depression 47 surrounds nailhead 42.

A clawed nail removal device, such as cat's paw 60, is then used to remove nail 40, as seen in FIG. 7. Tool 10 or a piece of wood or other material (not shown) is placed against the surface of anchored substrate 46 in the area where the head of cat's paw 60 will come into contact in order to prevent damage to the surface of anchored substrate 46 in that area during nail removal.

After removal of nail 40, suitable filler material can be placed into dimpled depression 47 and smoothed out.

If debris from anchored substrate 46 enters nailhead receiving cavity 22, it is normally continuously pushed up to the top of conical end cavity 24 and out through cleanout channel 26. If for some reason the debris becomes embedded, a nail or piece of wire can be inserted into cylindrical cleanout channel 26 to force the embedded material out of nailhead receiving cavity 22.

It is envisioned that tool 10 would be marketed in sets containing two or more tools 10 having nail receiving cavities 22 of different diameters for use with nails of various sizes. For example, a set of three tools 10 having the nail receiving cavity 22 diameters described above relative to 2D, 3D–8D and 10D–20D nail size ranges would be a convenient set to have available for use.

Tool 10 has been described in the preferred embodiments above as being a free standing tool. However, tool 10 can be removably or permanently attached to a cat's paw 60 in the area 62 delineated by the dotted line in FIG. 7, or to other nail removal claw devices. In such alternative embodiments the length of tool 10 can be shortened and the top 14 would be flattened to allow attachment to a nail removal claw device.

Although the illustration of the nail 40 in the drawings shows a nail having an enlarged flat head, the tool 10 of the present invention can also be used to remove finishing nails, in which case the diameter of nailhead receiving cavity 22 would be slightly larger than the diameter of the head of the finishing nail to be removed.

A modified form of the tool 10 described above can be used to remove staples from a substrate. The cross-section of the fastener receiving cavity and cutting lip of such a modified tool would be substantially rectangular to conform to the outer perimeter of a staple.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A tool for use in removing a non-threaded fastener from a first substrate anchored to a second substrate by said fastener, said tool comprising:

a shank having a longitudinal axis, first and second ends, and an exterior surface;

a driving head located on said first end of said shank;

a fastener exposure/dimpling head located on said second end of said shank;

said fastener exposure/dimpling head including a fastener receiving cavity extending into said shank, a cutting lip extending outwardly from said fastener receiving cavity, said cutting lip having an outer edge that lies entirely within the same plane, and a rounded dimpling section located between said cutting lip and said exterior surface of said shank.

2. The tool of claim 1 wherein said rounded dimpling section is substantially a one-quarter arc of a circle.

3. The tool of claim 2 wherein said rounded dimpling section. has a radius of about 0.250 inch.

4. The tool of claim 1 wherein said fastener exposure/dimpling head includes an angled transition section located between said cutting lip and said dimpling section.

5. The tool of claim 4 wherein said angled transition section is at an angle of about 30 degrees to the longitudinal axis of said shank.

6. The tool of claim 1 wherein said fastener receiving cavity has a longitudinal axis that is coaxial with the longitudinal axis of said shank.

7. The tool of claim 1 wherein said fastener receiving cavity has a circular cross-section.

8. The tool of claim 1 wherein said fastener receiving cavity has a substantially rectangular cross-section.

9. The tool of claim 1 including a cleanout channel communicating said fastener receiving cavity with the exterior surface of said shank.

10. The tool of claim 9 wherein said cleanout channel extends upwards at an angle to the longitudinal axis of said shank.

11. The tool of claim 10 wherein said angle is about 30 degrees.

12. The tool of claim 1 wherein said driving head is convex.

13. A tool set including at least two tools for use in removing non-threaded fasteners of various sizes from a first substrate anchored to a second substrate by said fasteners, each said tool comprising:

a shank having a longitudinal axis, first and second ends, and an exterior surface;

a driving head located on said first end of said shank;

a fastener exposure/dimpling head located on said second end of said shank;

said fastener exposure/dimpling head including a fastener receiving cavity extending into said shank, a cutting lip extending outwardly from said fastener receiving cavity, said cutting lip having an outer edge that lies entirely within the same plane, and a rounded dimpling section located between said cutting lip and said exterior surface of said shank;

each said tool in said set having a different size fastener receiving cavity.

14. The tool set of claim 13 wherein there are first, second and third tools, said first tool having a fastener receiving cavity adapted to receive the head of a 2D nail, said second tool having a fastener receiving cavity sized to receive the heads of nails having a size between 3D and about 8D, said third tool having a fastener receiving cavity adapted to receive the heads of nails having a size between about 10D and about 20D.

15. A tool for use in removing a non-threaded fastener from a first substrate anchored to a second substrate by said fastener, said tool comprising:

a shank having a longitudinal axis, first and second ends, and an exterior surface;

a driving head located on said first end of said shank;

a fastener exposure/dimpling head located on said second end of said shank;

said fastener exposure/dimpling head including a fastener receiving cavity extending into said shank, said fastener receiving cavity having a cross-section selected from the group consisting of circular and substantially rectangular, a cutting lip extending outwardly from said fastener receiving cavity, and, a dimpling section located between said cutting lip and said exterior surface of said shank.

16. The tool of claim 15 wherein said cross-section of said fastener receiving cavity is circular.

17. The tool of claim 15 wherein said cross-section of said fastener receiving cavity is substantially rectangular.

18. A tool for use in removing a non-threaded fastener from a first substrate anchored to a second substrate by said fastener, said tool comprising:

a shank having a longitudinal axis, first and second ends, and an exterior surface;

a driving head located on said first end of said shank;

a fastener exposure/dimpling head located on said second of said shank;

said fastener exposure/dimpling head including a fastener receiving cavity extending into said shank, a cutting lip extending outwardly from said fastener receiving cavity, and a dimpling section located between said cutting lip and said exterior surface of said shank; and a cleanout channel communicating said fastener receiving cavity with the exterior surface of said shank.

19. The tool of claim 18 wherein said cleanout channel extends upwards at an angle to the longitudinal axis of said shank.

20. The tool of claim 19 wherein said angle is about 30 degrees.

* * * * *